US012448874B2

(12) United States Patent
Shelton

(10) Patent No.: US 12,448,874 B2
(45) Date of Patent: Oct. 21, 2025

(54) PERFORATING GUN FIRING SWITCH

(71) Applicant: HARRISON JET GUNS II, L.P., Kennedale, TX (US)

(72) Inventor: James F. Shelton, Kennedale, TX (US)

(73) Assignee: HARRISON JET GUNS II, L.P., Kennedale, TX (US)

( * ) Notice: Subject to any disclaimer, the term of this patent is extended or adjusted under 35 U.S.C. 154(b) by 85 days.

(21) Appl. No.: 18/435,485

(22) Filed: Feb. 7, 2024

(65) Prior Publication Data

US 2024/0271508 A1 Aug. 15, 2024

Related U.S. Application Data

(60) Provisional application No. 63/445,803, filed on Feb. 15, 2023.

(51) Int. Cl.
*E21B 43/117* (2006.01)
*E21B 43/1185* (2006.01)

(52) U.S. Cl.
CPC ..... *E21B 43/117* (2013.01); *E21B 43/1185* (2013.01)

(58) Field of Classification Search
CPC ..... E21B 43/1185; E21B 43/117; F42D 1/05; F42D 1/043
See application file for complete search history.

(56) References Cited

U.S. PATENT DOCUMENTS

| | | | | |
|---|---|---|---|---|
| 3,115,832 | A * | 12/1963 | Gres | F42C 14/045 102/225 |
| 4,886,126 | A * | 12/1989 | Yates, Jr. | E21B 43/11852 175/4.54 |
| 11,697,980 | B2 * | 7/2023 | Goyeneche | F42B 3/02 175/4.57 |
| 2012/0255842 | A1 | 10/2012 | Runkel | |
| 2021/0048284 | A1 | 2/2021 | Maxted et al. | |
| 2024/0210151 | A1 * | 6/2024 | Roberts | E21B 17/028 |
| 2024/0271508 | A1 * | 8/2024 | Shelton | E21B 43/1185 |
| 2025/0027389 | A1 * | 1/2025 | Shelton | E21B 43/117 |
| 2025/0043667 | A1 * | 2/2025 | MacGillivray | E21B 43/117 |
| 2025/0101838 | A1 * | 3/2025 | Cook | E21B 43/1185 |

* cited by examiner

*Primary Examiner* — Daniel P Stephenson
(74) *Attorney, Agent, or Firm* — WARNER NORCROSS + JUDD LLP

(57) ABSTRACT

An improved firing switch for a perforating gun is provided. The firing switch includes a contact pin extending from a disc-shaped body portion, the contact pin providing an electrical connection for uphole communications. The firing switch also includes a ring-shaped grounding collar disposed about the outer periphery of the disc-shaped body portion, the grounding collar including a plurality of resilient fingers extending outwardly therefrom. The disc-shaped body portion further includes a plurality of axial openings, in lieu of a wiring interface, for a positive detonator connection and a negative detonator connection. The plurality of axial openings are disposed radially outward of the contact pin, which is centrally disposed on the disc-shaped body portion opposite of a threaded post.

20 Claims, 4 Drawing Sheets

PERFORATING GUN FIRING SWITCH

CROSS-REFERENCE TO RELATED APPLICATIONS

The present application claims the benefit of U.S. Provisional Application No. 63/445,803, filed Feb. 15, 2023, the disclosure of which is incorporated by reference.

TECHNICAL FIELD

The present invention relates to a firing switch for a perforating gun system having penetrating shaped charges to generate perforations through a wellbore casing.

BACKGROUND

In oil and gas operations, a gun string can be lowered into a wellbore on a wireline, slickline, or coiled tubing, opposite a hydrocarbon formation. A gun string includes multiple perforating guns connected end-to-end and sequentially detonated within the wellbore via an electrical signal sent from the surface. The lowest gun is typically fired first, such that the gun string can be repositioned at the desired well depth for firing of the next lowest gun in the gun string. The resulting perforations allow hydrocarbons to flow into the wellbore.

Each perforating gun in the gun string includes shaped charges that, when fired, are formed into high-velocity jets that penetrate through the wellbore casing. The shaped charges are detonated by a detonating cord, which in turn is ballistically connected to a detonator that is triggered by a firing switch. The firing switch includes an addressable switch that is electronically actuated from the surface. In this arrangement, a single firing switch will detonate all of the shaped charges in the perforating gun.

To prevent accidental detonation of the shaped charges, known firing switches can include a cable connected to ground, cables for incoming and outgoing communications, and two switching cables (+ and −) for the firing signal. The communication cables allow the status of each perforating gun to be checked while downhole, with the ability to skip a perforating gun in the case of a misfire, rather than requiring removal from the wellbore.

Despite their widespread acceptance for wellbore operations, there remains a continued need for an improved firing switch. In particular, there remains a continued need for an easy-to-install firing switch that ensures the reliable detonation of a perforating gun in a downhole gun string with a reduced risk of accidental misfires.

SUMMARY OF THE INVENTION

An improved firing switch for a perforating gun is provided. The firing switch includes a contact pin extending from a disc-shaped body portion, the contact pin providing an electrical connection for uphole communications. The firing switch also includes a ring-shaped grounding collar disposed about the outer periphery of the disc-shaped body portion, the grounding collar including a plurality of resilient fingers extending outwardly therefrom. The disc-shaped body portion further includes a plurality of threaded openings, in lieu of a wiring interface, for a positive detonator connection and a negative detonator connection. The plurality of threaded openings are disposed radially outward of the contact pin, which is centrally disposed on the disc-shaped body portion opposite of a threaded post.

In one embodiment, the grounding collar is integrally formed with the plurality of resilient fingers, each being formed of a conductive material. The resilient fingers are uniformly disposed about the grounding collar and include a radial segment and an axial segment, the axial segment being oriented in a direction opposite of the contact pin. The disc-shaped body portion is formed of a non-conductive material, and each of the plurality of threaded openings include an internally threaded insert formed of a conductive material.

In another embodiment, the firing switch includes an addressable switch housing extending axially from the disc-shaped body portion. The firing switch also includes an optional detonator cord housing that is laterally adjacent to the addressable switch housing. The addressable switch housing and the detonator cord housing each include a cylindrical sleeve and are optionally integrally formed with each other.

In these and other embodiments, the contact pin is directly attached to the firing switch, and the firing switch includes a 360-degree connection to ground. The threaded openings in the disc-shaped body portion include a positive detonator terminal, a negative detonator terminal, and an incoming communications terminal. Other auxiliary terminal openings can be included in other embodiments. The firing switch can be used with a perforating gun or a switch sub, optionally as part of a downhole gun string. The resilient fingers allow easy installation of the firing switch within a cylindrical opening. The firing switch is dimensioned such that it may be received within an open end of a shaped charge carrier, for example, which may also be connected to ground.

These and other features and advantages of the present invention will become apparent from the following description of the invention, when viewed in accordance with the accompanying drawings and appended claims.

Before embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION

Figure 1:
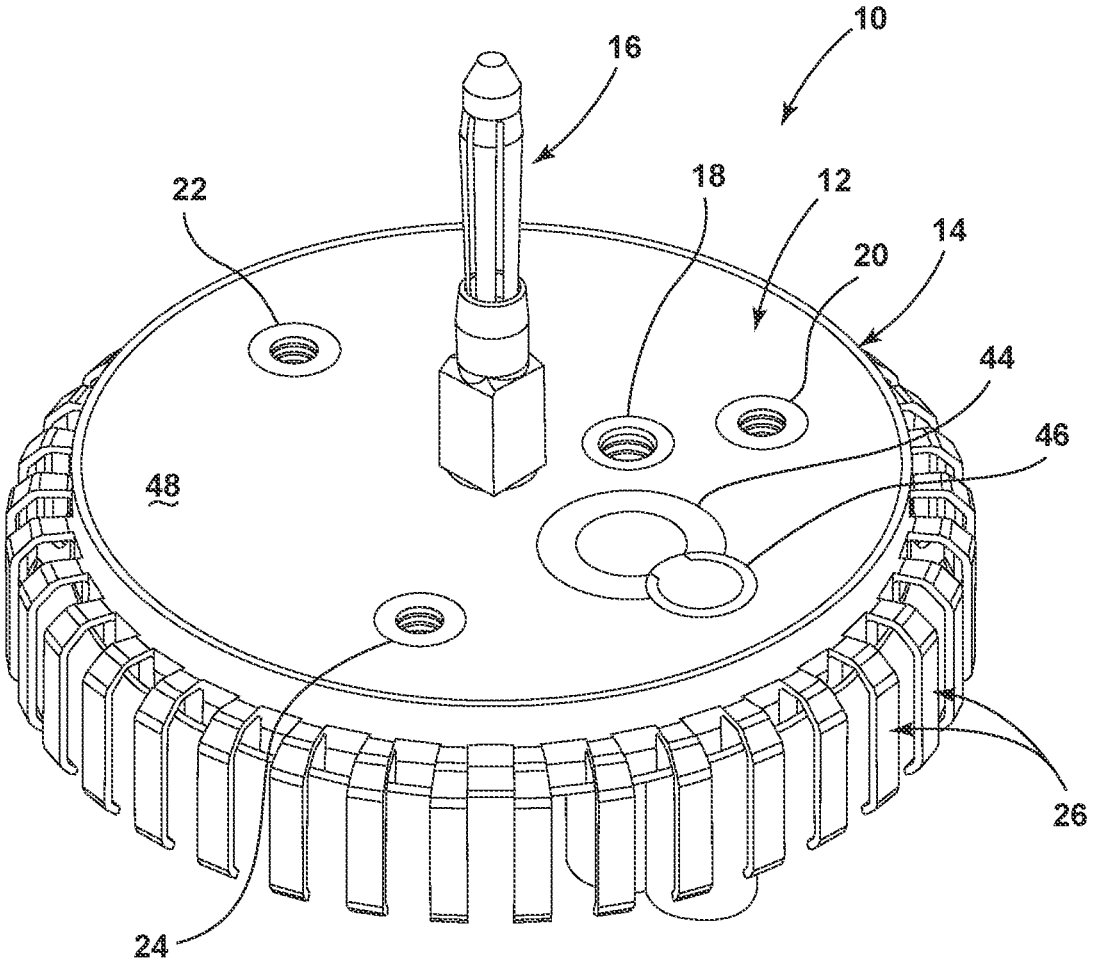
FIG. 1 is a perspective view of a firing switch for a perforating gun.
Figure 2:
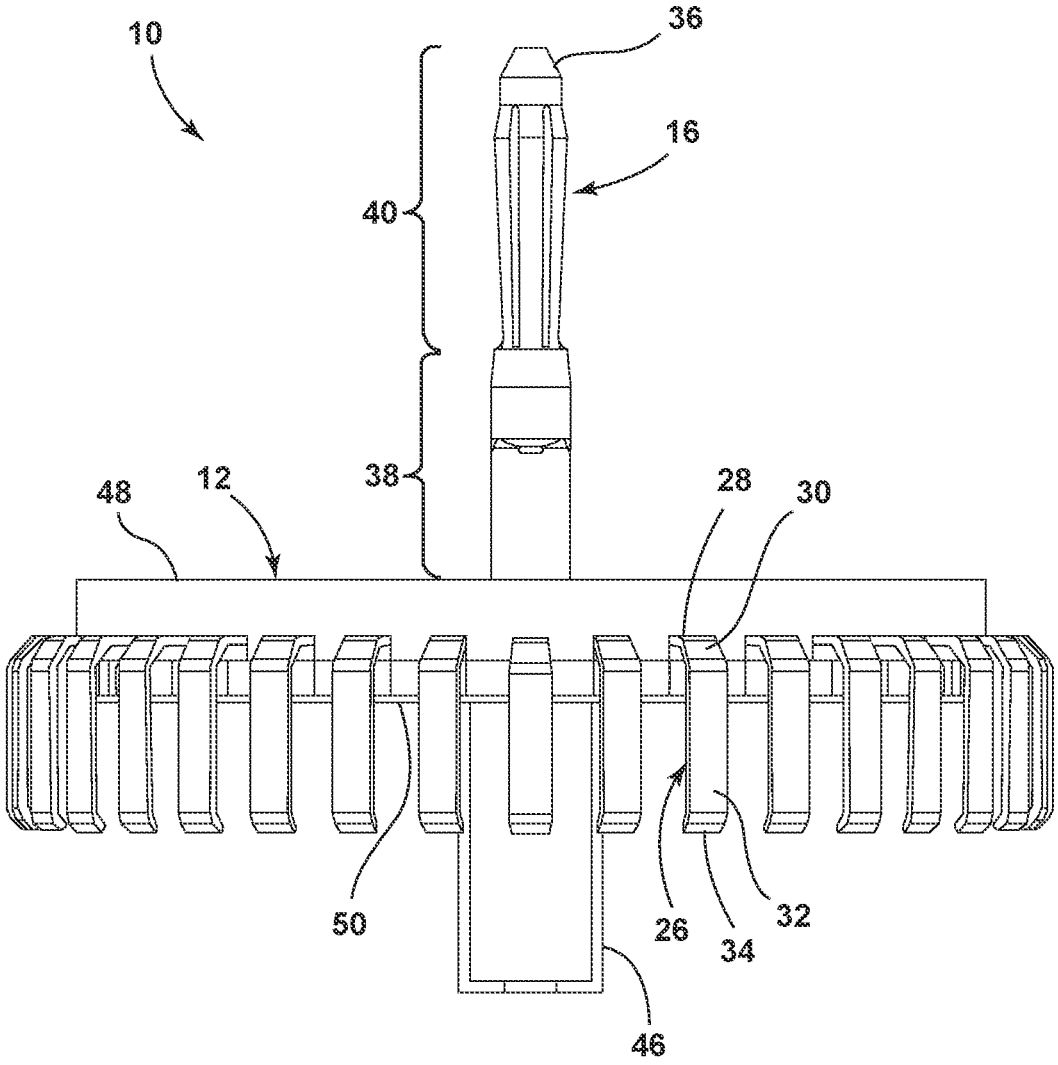
FIG. 2 is a side view of the firing switch of FIG. 1.

The following detailed description is merely exemplary in nature and is not intended to limit the oilfield perforating systems and methods as described herein. Furthermore, there is no intention to be bound by any theory presented in the preceding background or the following detailed description. The description is not in any way meant to limit the scope of any present or subsequent related claims.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

A firing switch for a perforating gun in accordance with an exemplary embodiment is illustrated in FIGS. 1-4 and generally designated 10. The firing switch 10 includes a disc-shaped body portion 12 surrounded by a grounding collar 14. A contact pin 16 extends from a disc-shaped body portion 12 for uphole communications. The disc-shaped body portion 12 further includes, in lieu of a wiring interface, a plurality of axial openings 18, 20, 22, 24, including a first opening 18 for a positive detonator terminal and a second opening 20 for a negative detonator terminal. The axial openings 18, 20, 22, 24 are disposed radially outward of the contact pin 16, which is centrally disposed on the disc-shaped body portion 12.

As also shown in FIGS. 1-4, the grounding collar 14 is formed of an electrically conductive material and includes a plurality of resilient fingers 26 for creating a secure connection to ground within a cylindrical opening. The resilient fingers 26 are uniformly disposed about the grounding collar 14 and include a radial segment 28, a beveled segment 30, an axial segment 32, and a terminal segment 34. The axial segment 32 is oriented downward as shown in the drawings, opposite of the contact pin 16. The terminal segment 34 is angled inwardly, toward a centerline axis of the firing switch 10. Any number of resilient fingers can be used as desired, with about thirty-six resilient fingers shown in FIGS. 1-4.

Figure 3:
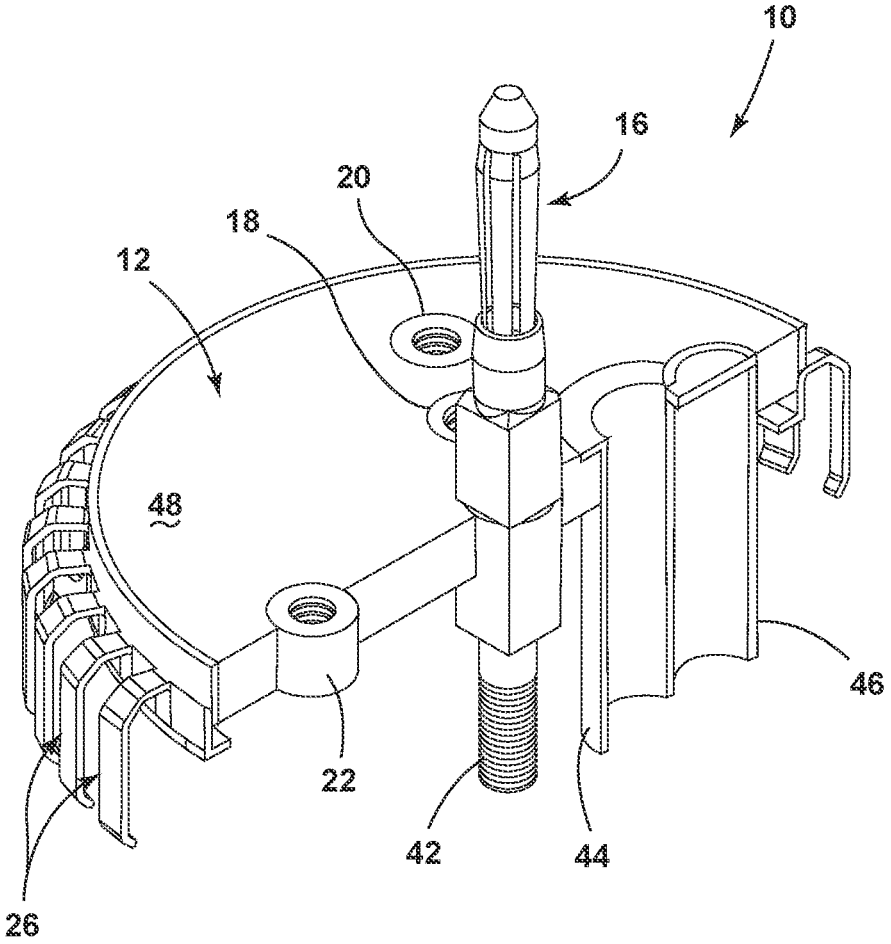
FIG. 3 is a first cross-sectional view of the firing switch of FIG. 1.
Figure 4:
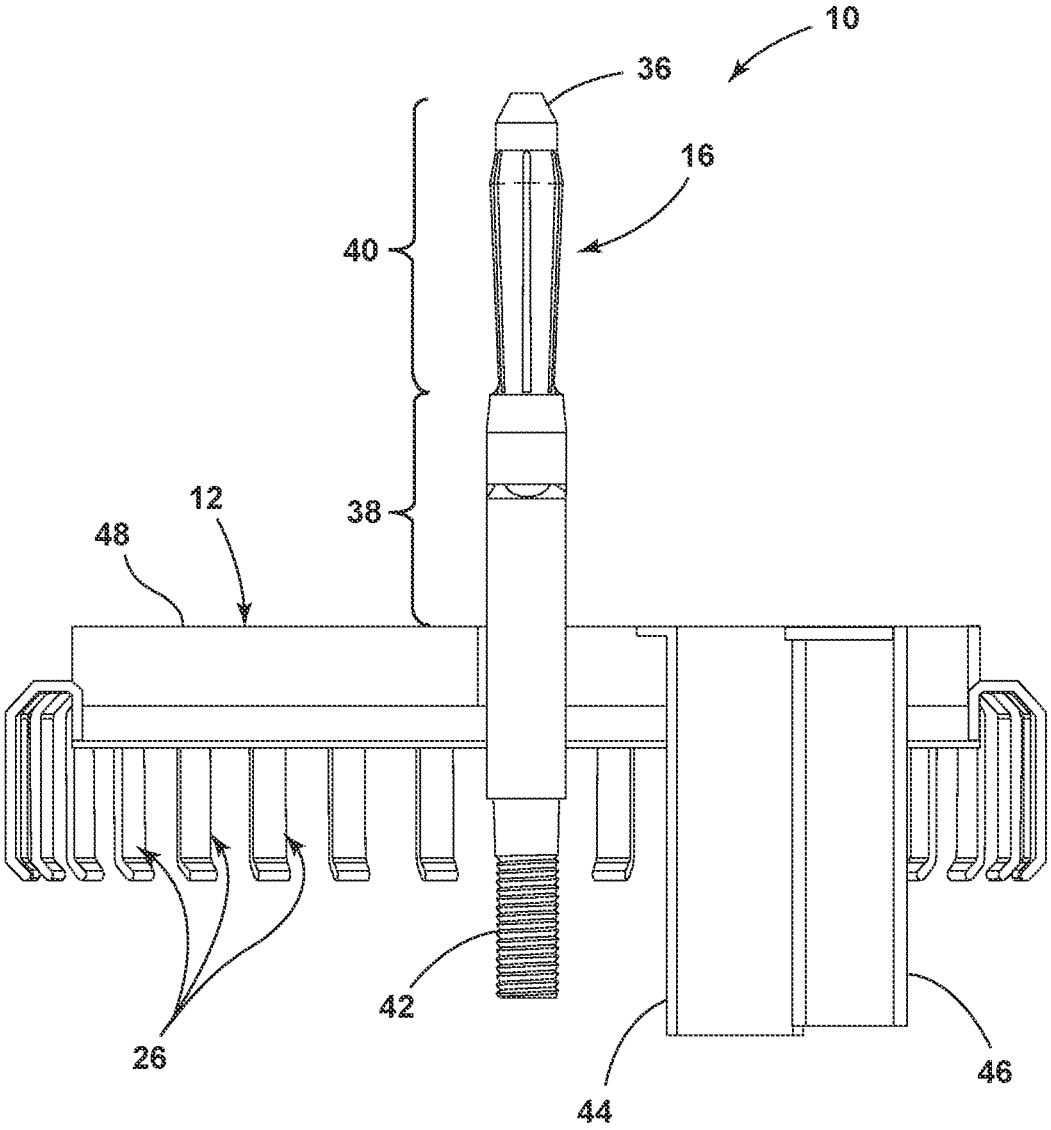
FIG. 4 is a second cross-sectional view of the firing switch of FIG. 1.

As noted above, the contact pin 16 is centrally disposed in the disc-shaped body portion 12. The contact pin 16 includes a tip 36, a base 38, and an outwardly bowed middle portion 40 with multiple deformable arms that compress radially inward when received within a socket opening. As best shown in FIGS. 3-4, the firing switch 10 also includes a threaded post 42 disposed opposite of the contact pin 16. The threaded post 42 extends from the underside of the body portion 12 in order to connect to the perforating gun below (if required), such that electrical continuity exists between the contact pin 16 and the threaded post 42.

As also shown in FIGS. 3-4, the firing switch 10 includes an addressable switch housing 44 extending axially from the disc-shaped body portion 12. The firing switch 10 also includes a detonator cord housing 46 that is laterally adjacent to the addressable switch housing 44. The addressable switch housing 44 and the detonator cord housing 46 each include a cylindrical sleeve and are optionally integrally formed with each other. The disc-shaped body portion 12 is formed of an electrically insulating material, for example a thermoplastic material, optionally PTFE. The disc-shaped body portion 12 also includes an upper surface 48, a lower surface 50, and an outer periphery therebetween, with the grounding collar 14 being in direct contact with the outer periphery of the disc-shaped body portion 12.

The firing switch 10 of the illustrated embodiment can be used with a perforating gun or a switch sub, optionally as part of a downhole gun string. The provision of resilient fingers 26 allows easy installation of the firing switch 10 within a cylindrical opening. The firing switch 10 is dimensioned such that it may be received within an open end of a shaped charge carrier, for example, which may also be connected to ground. As noted above, the plurality of openings include a threaded opening 18 for a positive detonator terminal and a threaded opening 20 for a negative detonator terminal. The plurality of openings replace conventional wiring interfaces found in existing firing switches, and are instead comprised of an internally threaded insert formed of a conductive material that is seated within an axial opening in the disc-shaped body portion 12.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

What is claimed is:

1. A firing switch for a perforating gun, the firing switch comprising:

a disc-shaped body portion including a upper surface, a lower surface, and an outer periphery therebetween;

a contact pin that extends from the disc-shaped body portion, the contact pin being centrally disposed and including an outwardly bowed portion with multiple deformable arms;

a grounding collar extending around the outer periphery of the disc-shaped body portion, the grounding collar including a plurality of resilient fingers extending therefrom;

an addressable switch housing extending axially from the disc-shaped body portion, wherein the disc-shaped body portion includes a plurality of openings extending therethrough, the plurality of opening being disposed radially outward of the contact pin.

2. The firing switch of claim 1, further including a conductive liner within each of the plurality of openings in the disc-shaped body portion.

3. The firing switch of claim 1, wherein the plurality of openings include a first opening for a positive command terminal and includes a second opening for a negative command terminal.

4. The firing switch of claim 1, wherein each of the plurality of resilient fingers include a radial segment and an axial segment.

5. The firing switch of claim 1, wherein the plurality of resilient fingers are uniformly disposed about the exterior of the grounding collar.

6. The firing switch of claim 1, further including a threaded post extending downwardly from the disc-shaped body portion opposite of the contact pin.

7. The firing switch of claim 1, further including a detonator cord housing laterally adjacent the adjacent the addressable switch housing.

8. The firing switch of claim 7, wherein the addressable switch housing and the detonator cord housing are integrally formed with each other.

9. The firing switch of claim 7, wherein the addressable switch housing and the detonator cord housing each include a cylindrical sleeve.

10. The firing switch of claim 1, wherein the disc-shaped body portion is formed from a thermoplastic material.

11. A firing switch for a perforating gun, the firing switch comprising:

a disc-shaped body portion including a upper surface, a lower surface, and a plurality of openings extending therethrough, the disc-shaped body portion being formed from a non-conductive material and having an outer periphery;

a grounding collar extending around the outer periphery of the disc-shaped body portion, the grounding collar including a plurality of resilient fingers that extend in a radial direction and in an axial direction to engage a cylindrical opening;

a contact pin that extends from the disc-shaped body portion, wherein the plurality of openings in the disc-shaped body portion includes a first opening for a positive electrical polarity and includes a second opening for a negative electrical polarity; and an addressable switch housing extending axially from the disc-shaped body portion.

12. The firing switch of claim 11, wherein each of the plurality of resilient fingers include a radial segment and an axial segment.

13. The firing switch of claim 11, wherein the plurality of resilient fingers are uniformly disposed about the exterior of the grounding collar.

14. The firing switch of claim 11, further including a threaded post extending downwardly from the disc-shaped body portion opposite of the contact pin.

15. The firing switch of claim 11, wherein the contact pin includes an outwardly bowed portion with multiple deformable arms that compress radially inward.

16. The firing switch of claim 11, further including a detonator cord housing laterally adjacent the adjacent the addressable switch housing.

17. The firing switch of claim 16, wherein the addressable switch housing and the detonator cord housing are integrally formed with each other.

18. The firing switch of claim 11, wherein the disc-shaped body portion is formed from a thermoplastic material.

19. The firing switch of claim 11, further including a conductive liner within each of the plurality of openings in the disc-shaped body portion.

20. The firing switch of claim 11, wherein each of the plurality of openings are disposed radially outward of the contact pin.

* * * * *